US011571075B2

(12) United States Patent
Stojanovic et al.

(10) Patent No.: US 11,571,075 B2
(45) Date of Patent: Feb. 7, 2023

(54) BEDDING OR SEATING PRODUCT HAVING TOPPER WITH AT LEAST ONE THERMALLY ENHANCED FOAM COMPONENT

(71) Applicant: L&P Property Management Company, South Gate, CA (US)

(72) Inventors: Heidi Stojanovic, Fort Smith, AR (US); Bruce W. Peterson, West Lake Hills, TX (US)

(73) Assignee: L&P Property Management Company, South Gate, CA (US)

( * ) Notice: Subject to any disclaimer, the term of this patent is extended or adjusted under 35 U.S.C. 154(b) by 13 days.

(21) Appl. No.: 17/245,629

(22) Filed: Apr. 30, 2021

(65) Prior Publication Data

US 2022/0346563 A1 Nov. 3, 2022

(51) Int. Cl.

| | |
|---|---|
| ***A47C 27/05*** | (2006.01) |
| ***A47C 27/00*** | (2006.01) |
| ***A47C 27/15*** | (2006.01) |
| ***A47C 27/14*** | (2006.01) |
| ***A47C 27/06*** | (2006.01) |

(52) U.S. Cl.

CPC ..... *A47C 27/056* (2013.01); *A47C 27/002* (2013.01); *A47C 27/062* (2013.01); *A47C 27/064* (2013.01); *A47C 27/148* (2013.01); *A47C 27/15* (2013.01)

(58) Field of Classification Search

CPC ... A47C 27/056; A47C 21/046; A47C 27/002; A47C 27/062; A47C 27/064; A47C 27/148; A47C 27/15; D06M 23/12

See application file for complete search history.

(56) References Cited

U.S. PATENT DOCUMENTS

| | | | | |
|---|---|---|---|---|
| 9,538,855 | B2 | 1/2017 | Gross et al. | |
| 9,943,173 | B2 | 4/2018 | Krtek et al. | |
| 9,968,202 | B2 | 5/2018 | Long | |
| 10,172,472 | B2 | 1/2019 | Long | |
| 10,329,469 | B2 | 6/2019 | Peterson et al. | |
| 10,738,228 | B2 | 8/2020 | Peterson et al. | |
| 10,750,877 | B2 | 8/2020 | Lisenbee et al. | |
| 10,973,339 | B2 | 4/2021 | Lisenbee et al. | |
| 11,202,514 | B1 * | 12/2021 | Blakely | A47C 27/05 |
| 2006/0030645 | A1 | 2/2006 | Hairston et al. | |

(Continued)

OTHER PUBLICATIONS

U.S. Patent and Trademark Office; Search Report and Written Opinion in related International Patent Application No. PCT/US2022/19297 dated Jun. 1, 2022; 11 pages.

*Primary Examiner* — Peter M. Cuomo
*Assistant Examiner* — Alison N Labarge
(74) *Attorney, Agent, or Firm* — Wood Herron & Evans LLP

(57) ABSTRACT

A three-layered topper fora bedding or seating product has a first piece of foam, a second piece of foam and a pocketed spring comfort layer therebetween. The pocketed spring comfort layer has individually pocketed mini coil springs. At least one of the foam pieces may be infused with metallic particles to improve thermal conductivity. Alternatively, at least one of the foam pieces may be infused with microencapsulated phase change materials to improve heat absorption. At least one of the foam pieces may have a coating to further improve thermal conductivity or heat absorption.

20 Claims, 11 Drawing Sheets

(56) References Cited

U.S. PATENT DOCUMENTS

| | | | | |
|---|---|---|---|---|
| 2010/0212090 | A1* | 8/2010 | Stjerna | A47C 27/064 29/91 |
| 2014/0141233 | A1 | 5/2014 | Crawford et al. | |
| 2014/0183403 | A1 | 7/2014 | Peterson et al. | |
| 2015/0026893 | A1* | 1/2015 | Garrett | A47C 27/064 5/691 |
| 2015/0230621 | A1* | 8/2015 | Spinks | B68G 9/00 5/698 |
| 2016/0235213 | A1* | 8/2016 | Long | A47C 27/064 |
| 2019/0343294 | A1* | 11/2019 | DeMoss | A47C 27/056 |
| 2020/0317978 | A1 | 10/2020 | Peterson et al. | |
| 2020/0375381 | A1* | 12/2020 | Codos | A47C 27/05 |
| 2021/0052082 | A1 | 2/2021 | Long et al. | |
| 2021/0120965 | A1 | 4/2021 | Abdulbaki et al. | |
| 2021/0161301 | A1* | 6/2021 | Smiderle | A47C 21/06 |
| 2021/0212474 | A1* | 7/2021 | Chunglo | A47C 27/14 |

* cited by examiner

BEDDING OR SEATING PRODUCT HAVING TOPPER WITH AT LEAST ONE THERMALLY ENHANCED FOAM COMPONENT

TECHNICAL FIELD OF THE INVENTION

This invention relates to a topper for bedding and seating products. More particularly, this invention relates to a topper comprising a pocketed spring comfort layer sandwiched between foam components.

BACKGROUND OF THE INVENTION

Pocketed spring comfort layers have been used in seating or bedding products above/below a core of the bedding or seating product. The core of the bedding or seating product may comprise a pocketed spring assembly. Alternatively, the core of the bedding or seating product may comprise unpocketed metal coil springs joined into a spring assembly. Another alternative for the core of the bedding or seating product may be one or more pieces of foam.

The pocketed spring comfort layers may comprise two pieces of fabric welded around metal mini coil springs as disclosed in U.S. Pat. Nos. 9,968,202 and 9,943,173, which are each fully incorporated by reference herein. Such comfort layers commonly have one layer of fabric above and one layer of fabric below mini coil springs. The fabric may allow air to flow between pockets and into and out of the pockets.

U.S. Pat. Nos. 10,329,469, 10,973,339, 10,750,877, and 10,738,228 and U.S. Patent Publication No. 2020/0317978, each of which is fully incorporated by reference herein, disclose foam infused with thermally conductive materials such as metals, graphite, silicon carbide, carbon nanotubes. The thermally conductive materials are spread throughout the foam in-situ. However, such infused foams have not been used in toppers like the toppers disclosed herein having a pocketed spring comfort layer included in the topper.

Mattress manufacturers have created a topper comprising a pocketed spring comfort layer between two pieces of non-thermally enhanced foam above a core of a bedding or seating product so that a user does not detect or feel the pocketed spring comfort layer. However, the thermally enhanced foams disclosed herein have not been used in such a topper to dissipate heat away from the user.

One drawback to known toppers is that heat from a person sleeping on the bedding product or mattress builds underneath the person due to the foam of the comfort layer. Such heat may cause a user to lose sleep or not sleep as well as if the mattress were cooler. The same may occur in a seating product in which case a person seated on the product may become uncomfortably hot in his/her part of the body contacting the seating product.

It is therefore an objective of this invention to provide a topper including a pocketed spring comfort layer adapted to overlay a core of a seating or bedding product to reduce heat underneath the user.

It is another objective of this invention to provide a seating or bedding product having a topper covering a core, the topper including a pocketed spring comfort layer sandwiched between layers of foam, at least one of the layers of foam being thermally enhanced foam for purposes of providing reducing heat below a person.

It is another objective of this invention to provide a seating or bedding product having a core and a topper covering the core, the topper including a pocketed spring comfort layer sandwiched between layers of thermally enhanced foam for cooling purposes.

SUMMARY OF THE INVENTION

The invention, which accomplishes these objectives, comprises a topper configured to overlay a core of a seating or bedding product. The topper comprises a first or upper piece of foam, a second or lower piece of foam and a pocketed spring comfort layer therebetween. In a single-sided bedding or seating product, a three-layered topper is located above a core of the bedding or seating product. In a double-sided bedding or seating product, a three-layered topper may be above the core and another three-layered topper may be below the core.

The pocketed spring comfort layer may be any known pocketed spring comfort layer. One type of pocketed spring comfort layer comprises an assembly or matrix of individually pocketed mini coil springs. The pocketed spring comfort layer comprises a first piece of fabric on one side of the mini coil springs and a second piece of fabric on the other side of the mini coil springs. The first and second pieces of fabric are joined by weld seams at least partially surrounding each of the mini coil springs, thereby creating pockets. In most embodiments, the first and second pieces of fabric are permeable to airflow. In many embodiments, the first and second pieces of fabric are made of non-woven polypropylene material, commonly used in the bedding industry.

In one embodiment of topper, the first and second pieces of foam, on opposite sides of the pocketed comfort layer, are thermally enhanced. For purposes of this document, a thermally enhanced piece of foam means the piece of foam has thermally conductive or heat absorbing materials in the form of powders, flakes, particles and the like incorporated or infused into the piece of foam in-situ. Examples of such thermally conductive materials include but are not limited to the following: metallic particles, carbon fibers, carbon nanotubes, silicon carbide, synthetic diamond, boron nitride and carbon nanoplatelets. Examples of heat absorbing materials include but are not limited to the following: microencapsulated phase change materials and gel materials.

At least one of the first and second pieces of foam may be flexible polyurethane or latex foam. It is within the scope of the present invention that the first and second pieces of foam, whether thermally enhanced or coated, may be identical. For example, one of the first and second pieces of foam may be made of flexible polyurethane and thermally enhanced while the other of the first and second pieces of foam may be made of flexible polyurethane and not thermally enhanced.

Alternatively, the first and second pieces of foam may be made of different foams. For example, one of the first and second pieces of foam may be made of flexible polyurethane and the other of the first and second pieces of foam may be made of latex.

According to another aspect of the invention, at least one of the first and second pieces of thermally enhanced foam may have a coating thereon. The coating usually covers only one outer surface of the piece of foam but may cover only a portion of a surface of the piece of foam. Alternatively, the coating may cover multiple outer surfaces of the piece of foam. The coating has thermal benefits such as having heat absorption or heat conductivity. The coating may have improved heat absorption characteristics due to microencapsulated phase change materials or gel materials incorporated into the coating. The coating may have improved thermal conductivity due to metallic or non-metallic particles being incorporated or infused into the coating. In either piece of foam, the coating is preferably proximate the pocketed spring comfort layer of the three-piece topper. However, the coating may cover at least a portion of the top and below outer surfaces of the piece of foam.

According to one embodiment of the invention, only the first piece or layer of foam above the pocketed spring comfort layer is thermally enhanced. The second piece or layer of foam inside the pocketed spring comfort layer may not be thermally enhanced. In some embodiments, the first piece of foam is infused with metallic particles. In other embodiments, the first piece of foam is infused with at least one of the following: carbon fibers, carbon nanotubes, microencapsulated phase change materials, silicon carbide, synthetic diamond or boron nitride. In embodiments in which only the first piece of foam is thermally enhanced, at least one of the first and second pieces of foam may have a coating thereon as described herein.

Any of the toppers shown or described herein may be incorporated into a bedding product, such as a mattress, mattress topper or pillow. Further, any of the embodiments of topper shown or described herein may be incorporated into a seating product, such as a vehicle seat and/or office or residential furniture, such as a recliner. Alternatively, any of the embodiments of topper shown or described herein may be sold independently as a retail or wholesale item. In such an application, the topper may be added to and/or removed from a bedding or seating product by a customer.

The topper of the present invention, whether incorporated inside a bedding or seating product, or manufactured and sold as a separate product, provides an additional cooling effect to the product due to conduction or convection through at least one piece of foam of the topper.

These and other objects and advantages of this invention will be more readily apparent from the following drawings, in which:

DETAILED DESCRIPTION OF THE DRAWINGS

Figure 1:
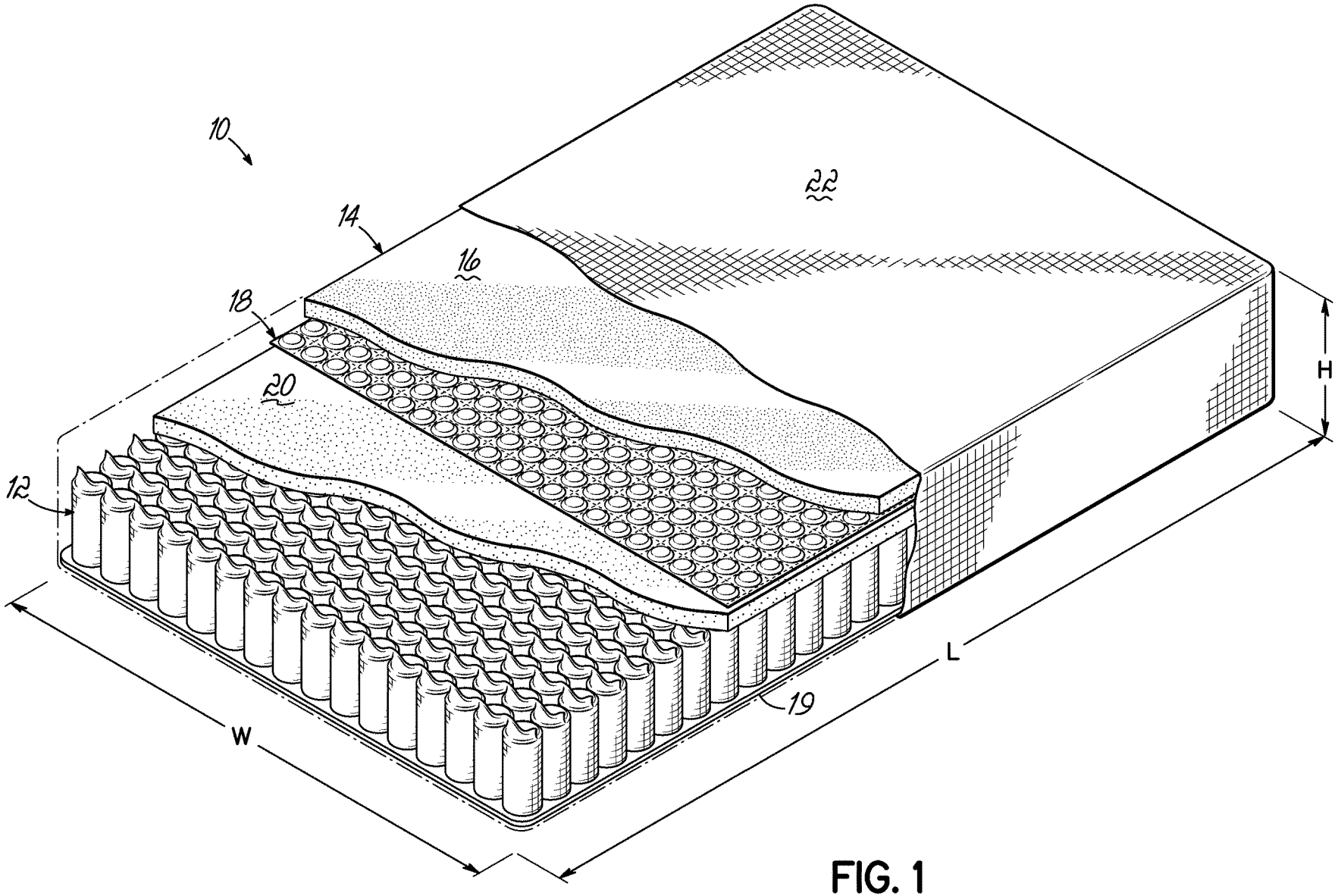
FIG. 1 is a perspective view, partially broken away, of a single-sided bedding product incorporating one of the toppers of the invention.

With reference to FIG. 1, there is illustrated a single-sided mattress 10 incorporating one embodiment of topper 14 in accordance with this invention. This mattress 10 comprises a spring core 12 over the top of which there is a topper 14. The topper 14 comprises a first or outer foam piece 16, a pocketed spring comfort layer 18 and a second or inner foam piece 20. As shown in FIG. 1, the first foam piece 16 is located above the pocketed spring comfort layer 18 and the second piece of foam 20 is below the pocketed spring comfort layer 18. This complete assembly may include a base 19 and is completely enclosed within an upholstered cover 22.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

In most embodiments, the first piece of foam 16 is secured to the pocketed spring comfort layer 18; so is the second piece of foam 20. The first and second pieces of foam 16, 20 are usually glued to the pocketed spring comfort layer 18 with adhesive. However, any other means of securing the first and second pieces of foam 16, 20 to the pocketed spring comfort layer 18 may be used. In other embodiments, one or both of the first and second pieces of foam may not be secured to the pocketed spring comfort layer 18. It is also within the scope of the present invention that the topper 14 has its own covering.

Although spring core 12 is illustrated being made of pocketed coil springs, the core of any of the products, such as mattresses shown or described herein, may be made wholly or partially of un-pocketed coil springs (not shown), one or more foam pieces (not shown) or any combination thereof. Any of the toppers described or shown herein may be used in any single or double-sided bedding or seating product having any core. The core may be any conventional core including, but not limited to, pocketed or un-pocketed spring cores. The novel topper of the present invention provides a cooling effect to a person laying on the spring core 12.

Figure 2:
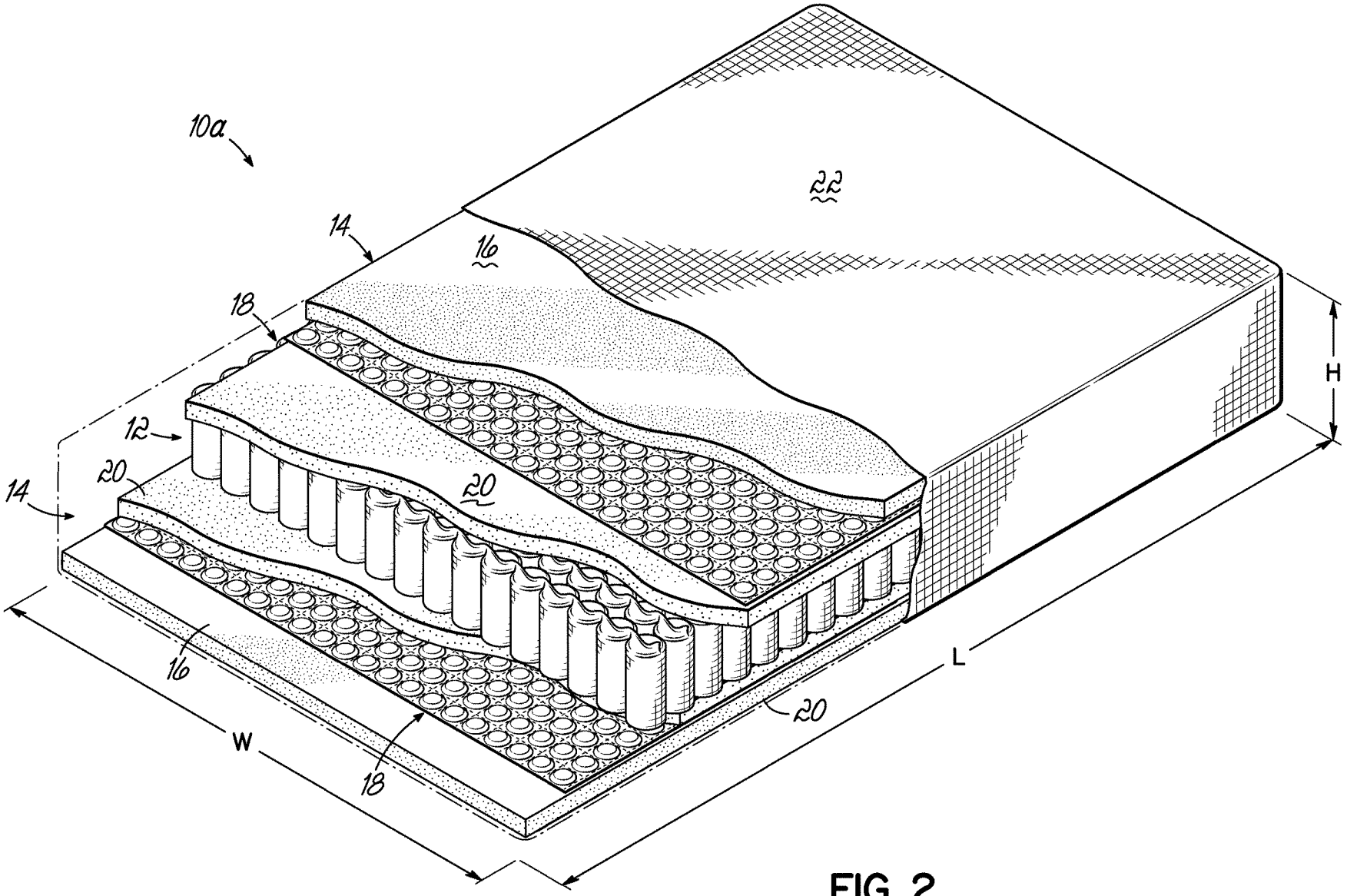
FIG. 2 is a perspective view, partially broken away, of a double-sided bedding product incorporating at least one of the toppers of the invention.

FIG. 2 illustrates a double-sided mattress 10*a* comprising a spring core 12 and toppers 14 above and below the spring core 12. The topper 14 below the spring core 12 is flipped relative to the topper 14 above the spring core. In other words, the first piece of foam 16 is always exterior to the second piece of foam 20. While toppers 14 shown in detail in FIG. 3 are shown in FIGS. 1 and 2, any topper shown or described herein may be used in connection with any single-sided mattress or double-sided mattress including mattresses shown or described herein.

Figure 3:
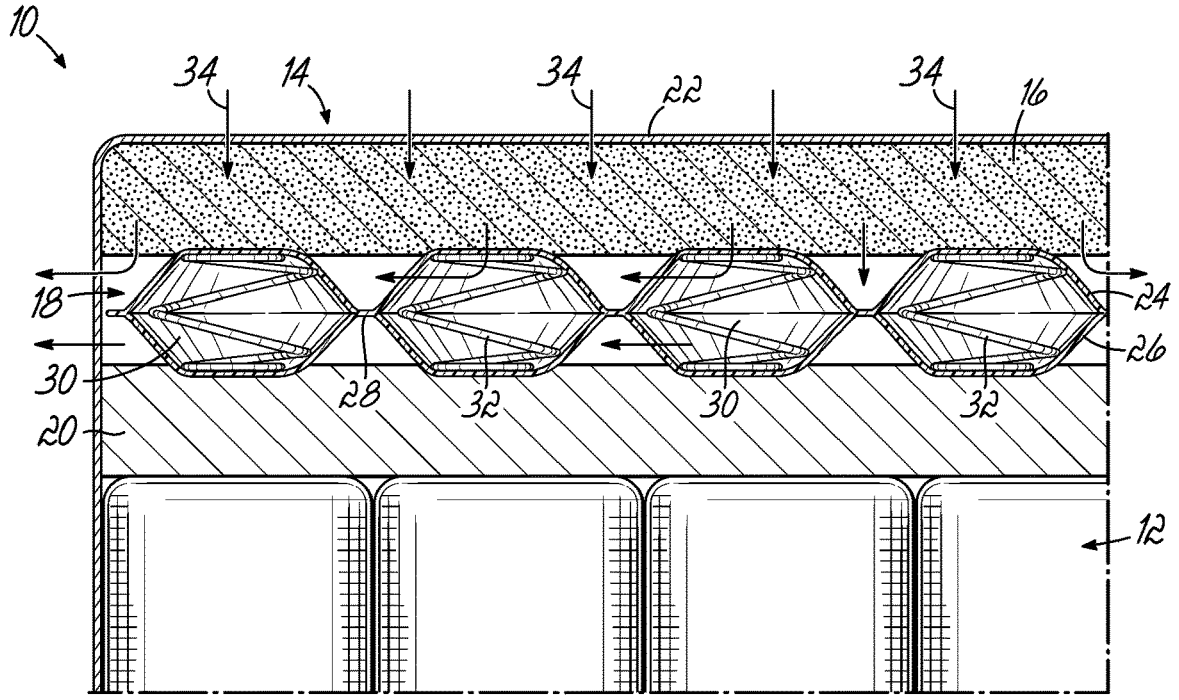
FIG. 3 is a cross-sectional view of a portion of the topper of FIG. 1 showing an outer thermally enhanced foam layer, an inner non thermally enhanced foam layer and a pocketed comfort layer therebetween.

FIG. 3 illustrates the components of one embodiment of topper 14 incorporated into the mattress 10 shown in FIG. 1 and mattress 10*a* shown in FIG. 2. The topper 14 comprises a first or outer piece of thermally enhanced foam 16, a pocketed spring comfort layer 18 and a second or inner piece of foam 20. The second or inner piece of foam 20 is not thermally enhanced and may be any flexible polyurethane or latex foam.

Figure 3A:
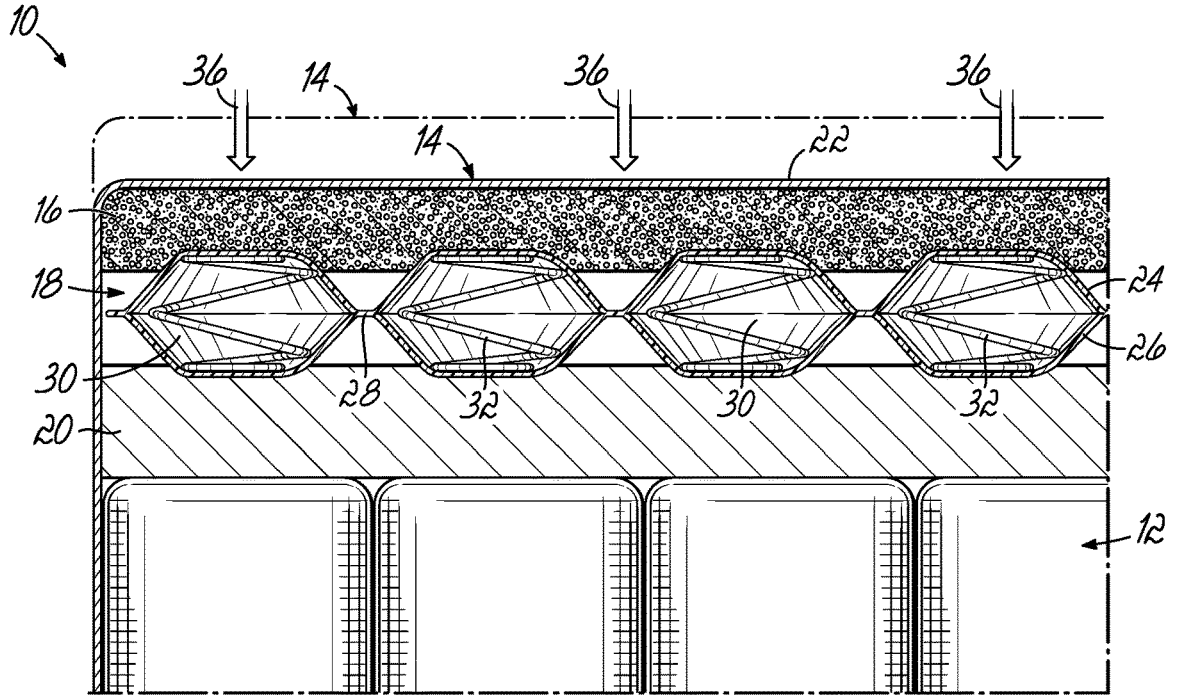
FIG. 3A is a cross-sectional view of the portion of the topper of FIG. 3 in a compressed condition.
Figure 3B:
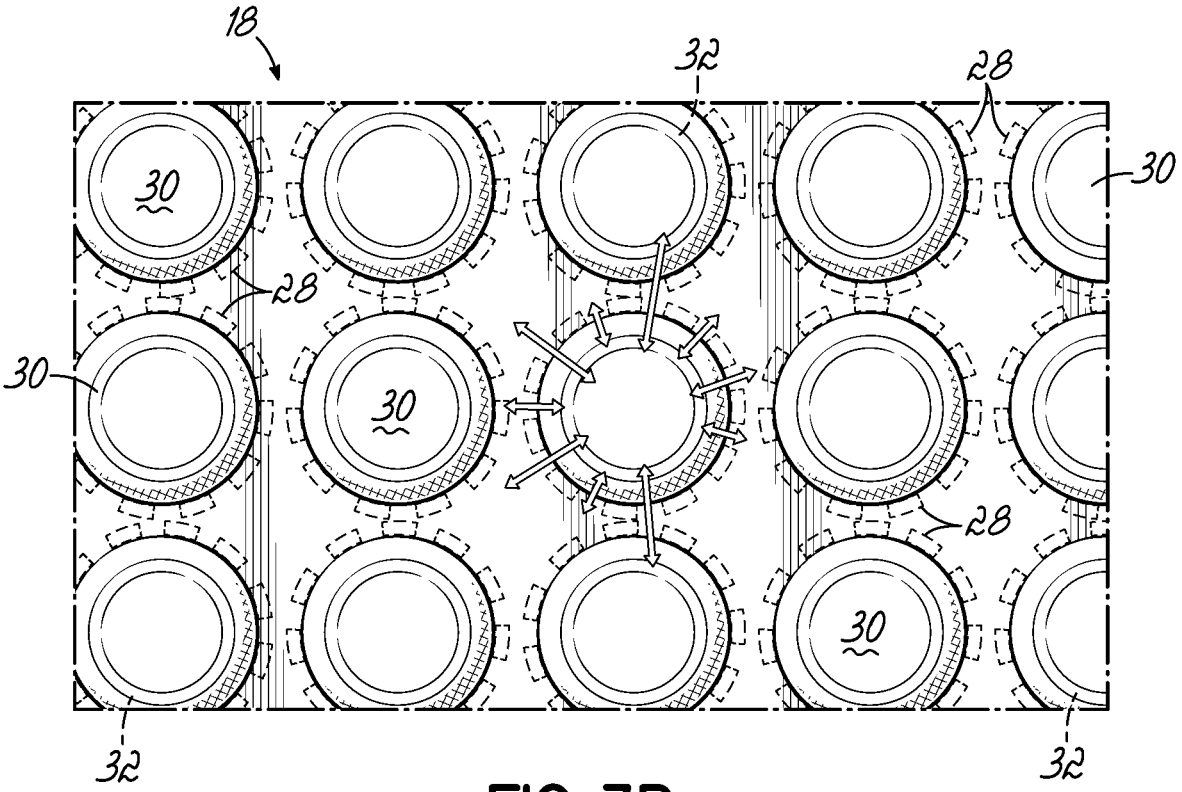
FIG. 3B is a top view of a portion of the pocketed comfort layer of FIG. 1.

The pocketed spring comfort layer 18 may be any known pocketed spring comfort layer made with first and second pieces of fabric 24, 26, respectively, permeable to airflow. In some embodiments the fabric may be non-woven polypropylene. As shown in FIGS. 3 and 3A, the first and second pieces of fabric are welded together with weld seams 28 creating pockets 30 containing mini coil springs 32. Although FIG. 3B illustrates one embodiment of pocketed spring comfort layer 18, any known pocketed spring comfort layer may be used in any of the toppers of the present invention.

One mini coil spring 32 in a relaxed condition may be approximately two inches tall, have a diameter of approximately three inches and be made of seventeen and one-half gauge wire. While compressed inside one of the pockets 30, each of the mini coil springs 32 may be approximately one and one-half inches tall. However, the mini coil springs 32 in a relaxed condition may be any desired height less than four inches, have any desired shape, such as an hourglass or barrel shape, have any desired diameter and/or be made of any desired wire thickness or gauge.

The first or outer piece of thermally enhanced foam 16 has at least some of the following particles infused therein: metallic particles, carbon fibers, carbon nanotubes, microencapsulated phase change materials, silicon carbide, synthetic diamond, boron nitride. As shown in FIG. 3, the first or outer piece of thermally enhanced foam 16 allows heat in the form of hot air to escape the interior of the mattress by passing through the first or outer piece of thermally enhanced foam 16 and through the pocketed spring comfort layer 18 as indicated by the arrows 34.

FIG. 3A illustrates a load placed on the mattress 10, the load being shown by the arrows 36. When a load is placed on top of the mattress 10, the topper 14 is compressed. The thermally conductive particles in the first or outer piece of thermally enhanced foam 16 move closer together than when the first or outer piece of thermally enhanced foam 16 is relaxed or not under a load. Thus, heat is passed from particle to particle in a conductive manner, thereby moving heat in the direction of arrows 34 away from the user of the product or mattress and out through the fabric of the pocketed spring comfort layer 18.

Figure 4:
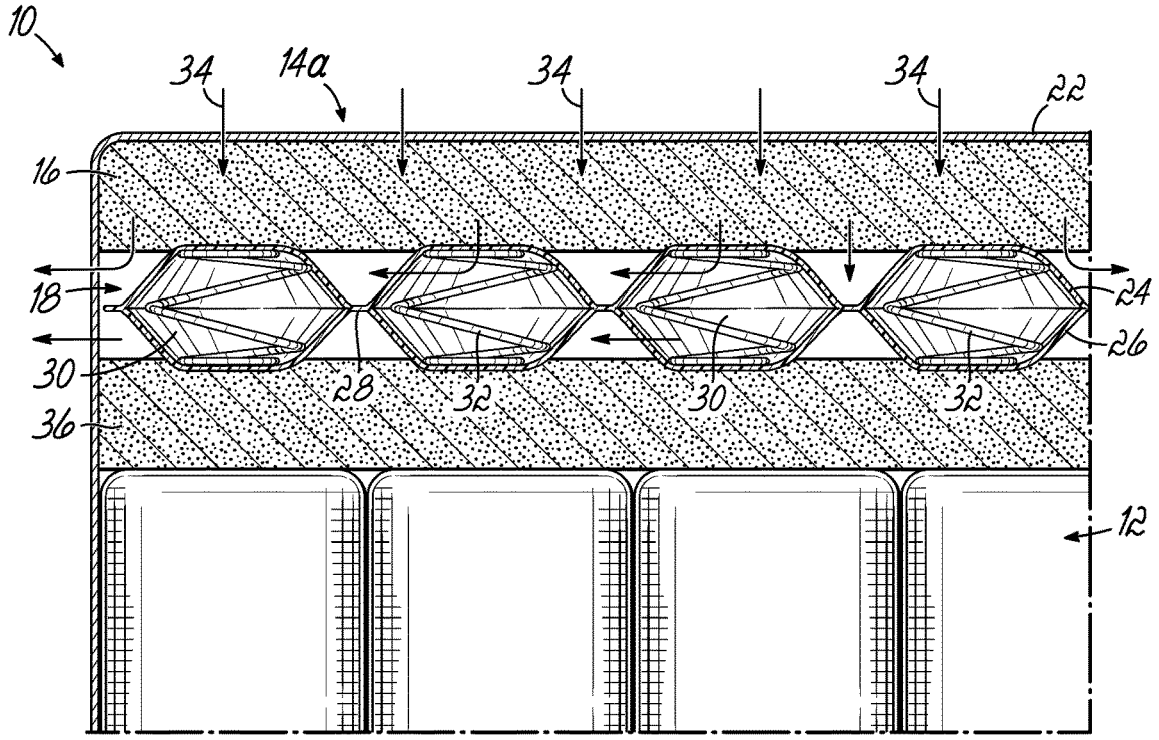
FIG. 4 is a cross-sectional view of a portion of an alternative topper showing inner and outer thermally enhanced foam layers and a pocketed comfort layer therebetween.

FIG. 4 illustrates an alternative embodiment of topper 14*a* which may be incorporated into any bedding or seating product including single-sided mattress 10 or double-sided mattress 10*a*. Topper 14*a* comprises the same first or outer piece of thermally enhanced foam 16 and same pocketed spring comfort layer 18 as the topper 14 shown in FIGS. 3 and 3A. However, topper 14*a* further comprises a second or inner piece of thermally enhanced foam 36, rather than a convention, non-thermally enhanced piece of flexible polyurethane or latex foam. The second or inner piece of thermally enhanced foam 36 may made of the same material as the first or outer piece of thermally enhanced foam 16. Alternatively, the second or inner piece of thermally enhanced foam 36 may made of a different material as the first or outer piece of thermally enhanced foam 16. Regardless of whether the second or inner piece of thermally enhanced foam 36 is made of the same foam as the first or outer piece of thermally enhanced foam 16, the first and second thermally enhanced pieces of foam 16, 36 may have different particles infused therein or the same particles in different densities.

Figure 5:
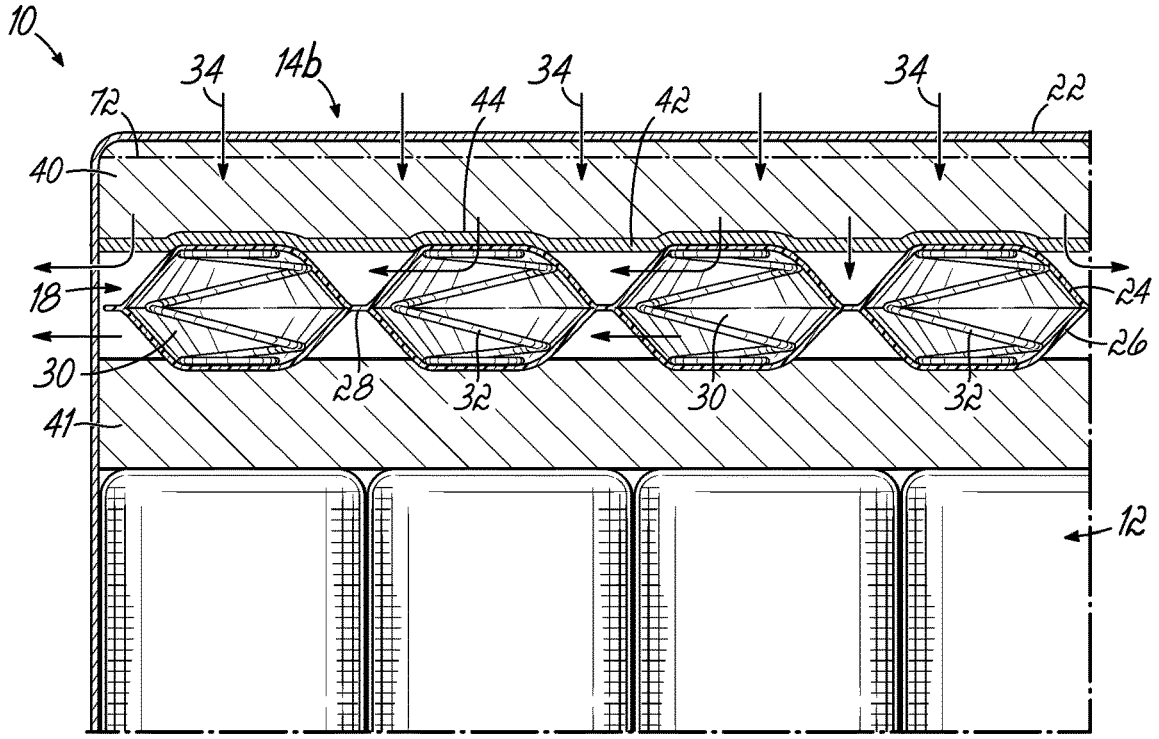
FIG. 5 is a cross-sectional view of a portion of an alternative topper showing inner and outer non thermally enhanced foam layers and a pocketed comfort layer therebetween, the outer foam layer being coated with at least one coating.

FIG. 5 illustrates an alternative embodiment of topper 14*b* which may be incorporated into any bedding or seating product including a single-sided mattress like mattress 10 or a double-sided mattress like mattress 10*a*. Topper 14*b* comprises a first or outer piece of coated, non-thermally enhanced foam 40, the same pocketed spring comfort layer 18 as the topper 14 shown in FIGS. 3 and 3A and a second or inner piece of uncoated, non-thermally enhanced foam 41. The coated first or outer piece of non-thermally enhanced foam 40 of topper 14*c* has a coating 42 covering at least a portion of an outer surface 44 thereof. As shown in FIG. 5, the coating 42 is proximate the pocketed spring comfort layer 18. As shown in FIG. 5, the coating 42 may touch or physically contact the first piece of fabric 24 of the pocketed spring comfort layer 18. The coating 42 may be any desired thickness. Its thickness is not intended to be limited by the drawings. The second or inner piece of foam 20 may made of the same foam as the first or outer piece of foam 40 or alternatively made of a different foam. One type of coating is disclosed in U.S. patent application Ser. No. 17/197,193, which is fully incorporated by reference herein.

Figure 6:
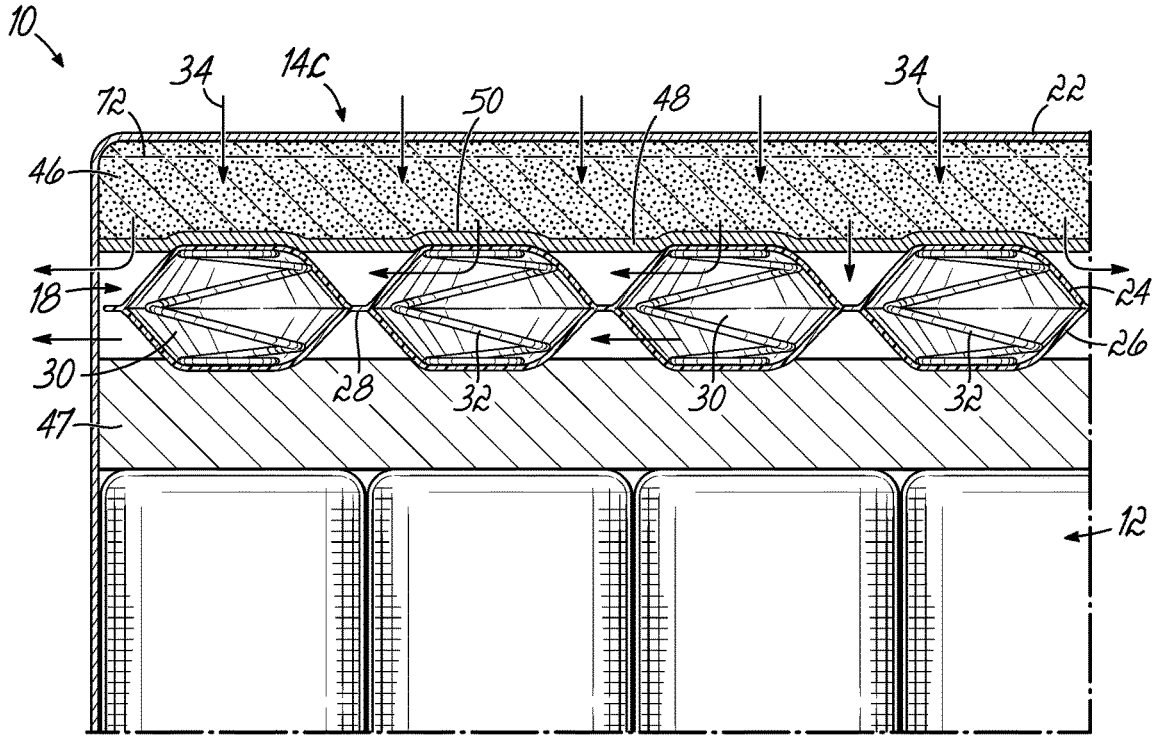
FIG. 6 is a cross-sectional view of a portion of an alternative topper showing an inner non thermally enhanced foam layer, an outer thermally enhanced foam layer and a pocketed comfort layer therebetween, the outer foam layer being coated with at least one coating.

FIG. 6 illustrates an alternative embodiment of topper 14*c*, which may be used in any bedding or seating product including a single-sided mattress such as mattress 10 or a double-sided mattress such as double-sided mattress 10*a*. Topper 14*c* comprises a first or outer piece of coated, thermally enhanced foam 46, pocketed spring comfort layer 18 and a second or inner piece of non-thermally enhanced foam 47. The first or outer piece of coated, thermally enhanced foam 46 of topper 14*d* has a coating 48 covering at least a portion of an outer surface 50 thereof. As shown in FIG. 6, the coating 48 is proximate the pocketed spring comfort layer 18. As shown in FIG. 6, the coating 48 may touch or physically contact the first piece of fabric 24 of the pocketed spring comfort layer 18. The coating 48 may be any desired thickness. Its thickness is not intended to be limited by the drawings. The second or inner piece of foam 20 may made of the same foam as the first or outer piece of thermally enhanced foam 46 or alternatively made of a different foam.

Figure 7:
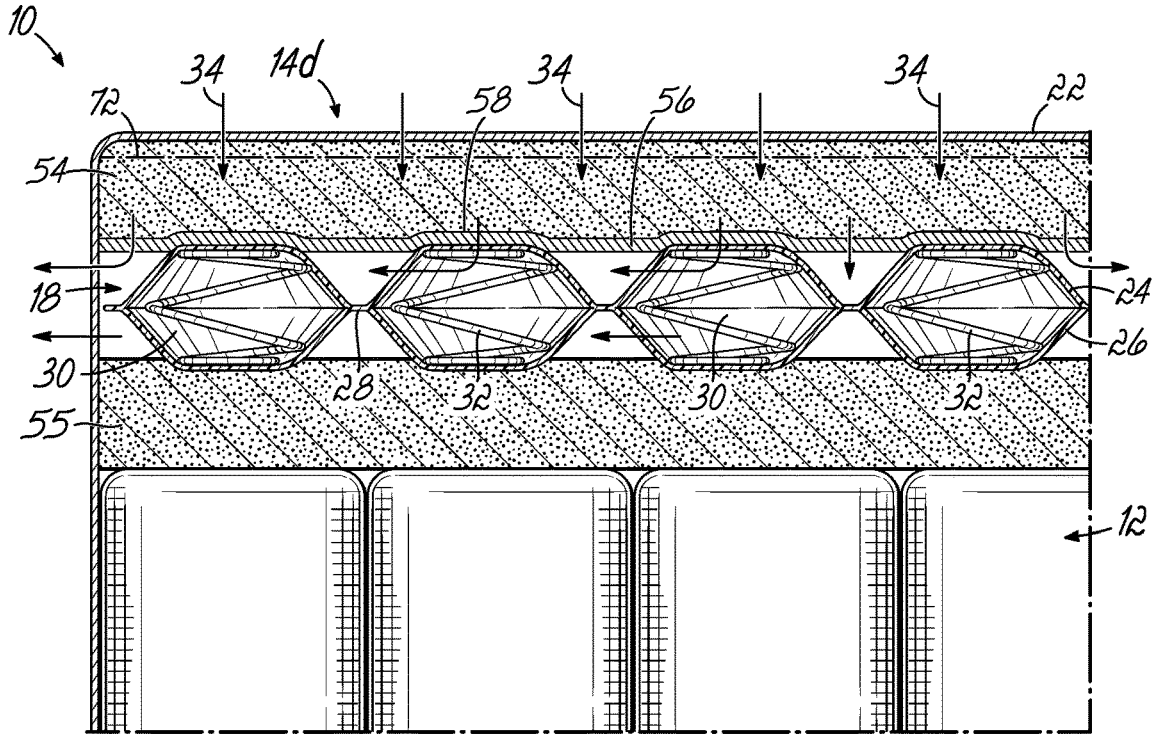
FIG. 7 is a cross-sectional view of a portion of an alternative topper showing inner and outer thermally enhanced foam layers and a pocketed comfort layer therebetween, the outer foam layer being coated with at least one coating.

FIG. 7 illustrates an alternative embodiment of topper 14*d*, which may be used in any bedding or seating product including a single-sided mattress such as mattress 10 or a double-sided mattress such as double-sided mattress 10*a*. Topper 14*d* comprises a first or outer piece of coated, thermally enhanced foam 54, pocketed spring comfort layer 18 and a second or inner piece of thermally enhanced foam 55. The first or outer piece of coated, thermally enhanced foam 54 of topper 14*d* has a coating 56 covering at least a portion of an outer surface 58 of the first or outer piece of thermally enhanced foam 54. As shown in FIG. 7, the coating 56 is proximate the pocketed spring comfort layer 18. As shown in FIG. 7, the coating 56 may touch or physically contact the first piece of fabric 24 of the pocketed spring comfort layer 18. The coating 56 may be any desired thickness. Its thickness is not intended to be limited by the drawings. The second or inner piece of thermally enhanced foam 55 has no coating and may made of the same foam as the coated first or outer piece of foam 54 or alternatively made of a different foam.

Figure 8:
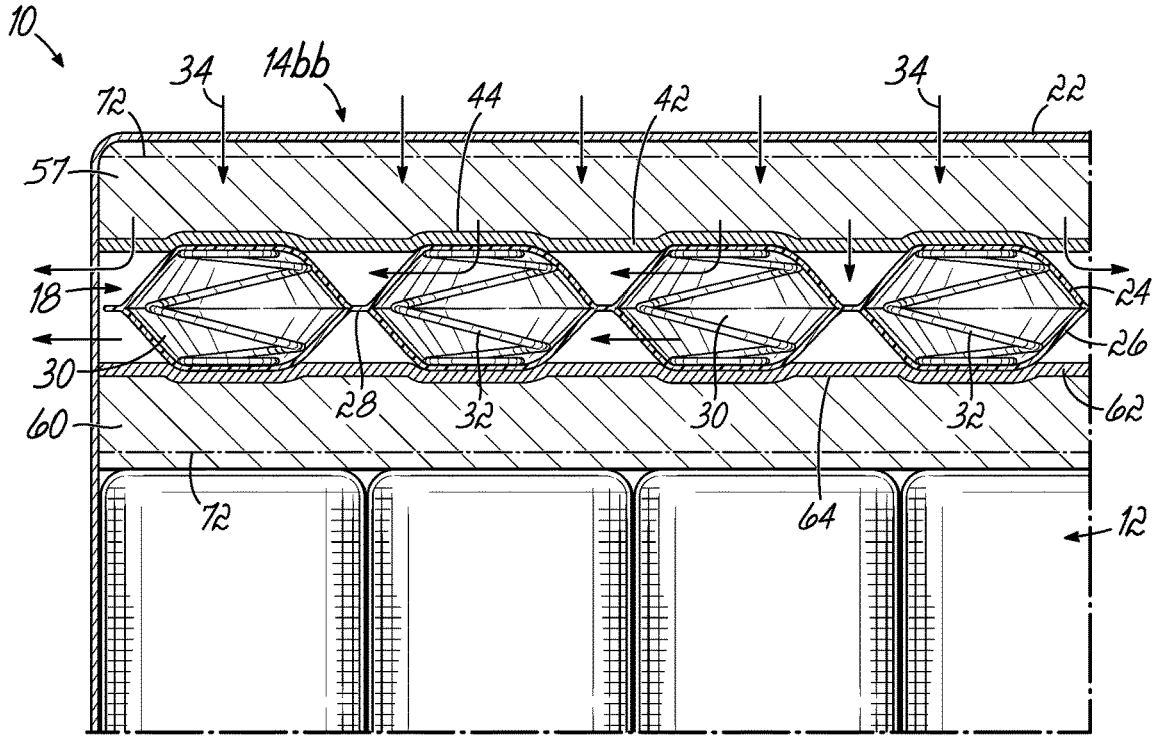
FIG. 8 is a cross-sectional view of a portion of an alternative topper showing inner and outer non thermally enhanced foam layers and a pocketed comfort layer therebetween, each of the foam layers being coated with at least one coating.

FIG. 8 illustrates an alternative embodiment of topper 14*bb* which may be incorporated into any bedding or seating product including a single-sided mattress like mattress 10 or a double-sided mattress like mattress 10*a*. Topper 14*bb* comprises a first or outer piece of coated non-thermally enhanced foam 57 and pocketed spring comfort layer 18. However, the second or inner piece of foam of topper 14*bb* is a coated, non-thermally enhanced foam 60. The second or inner piece of coated, non-thermally enhanced foam 60 of topper 14*bb* has a coating 62 covering at least a portion of an outer surface 64 of the second or inner piece of coated, thermally enhanced foam 60. As shown in FIG. 8, the coating 62 is proximate the pocketed spring comfort layer 18. As shown in FIG. 8, the coating 62 may touch or physically contact the first piece of fabric 24 of the pocketed spring comfort layer 18. The coating 62 may be any desired thickness. Its thickness is not intended to be limited by the drawings. The second or inner piece of coated foam 60 may made of the same foam as the first or outer piece of coated foam 57 or alternatively made of a different foam.

Figure 9:
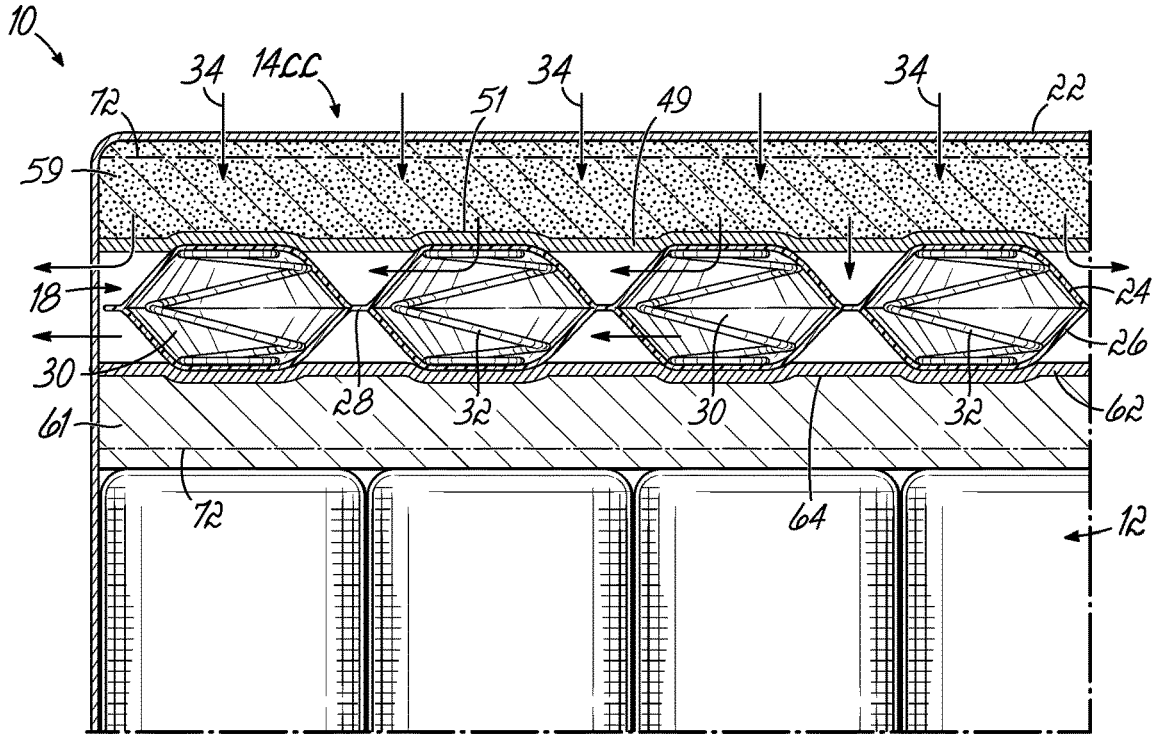
FIG. 9 is a cross-sectional view of a portion of an alternative topper showing an inner non thermally enhanced foam layer, an outer thermally enhanced foam layer and a pocketed comfort layer therebetween, each of the foam layers being coated with at least one coating.

FIG. 9 illustrates an alternative embodiment of topper 14*cc* which may be incorporated into any bedding or seating product including a single-sided mattress like mattress 10 or a double-sided mattress like mattress 10*a*. Topper 14*cc* comprises a first or outer piece of coated, thermally enhanced foam 59 and pocketed spring comfort layer 18. The first or outer piece of coated, thermally enhanced foam 59 of topper 14*cc* has a coating 49 covering at least a portion of an outer surface 51 thereof. As shown in FIG. 6, the coating 49 is proximate the pocketed spring comfort layer 18. As shown in FIG. 9, the coating 49 may touch or physically contact the first piece of fabric 24 of the pocketed spring comfort layer 18. The coating 49 may be any desired thickness. Its thickness is not intended to be limited by the drawings. The second or inner piece of foam 61 of topper 14*cc* is a coated, non-thermally enhanced foam. The second or inner piece of coated, non-thermally enhanced foam 61 of topper 14*cc* has a coating 62 covering at least a portion of an outer surface 64 of the second or inner piece of coated, non-thermally enhanced foam 61. As shown in FIG. 9, the coating 62 is proximate the pocketed spring comfort layer 18. As shown in FIG. 9, the coating 62 may touch or physically contact the second piece of fabric 26 of the pocketed spring comfort layer 18. The coating 62 may be any desired thickness. Its thickness is not intended to be limited by the drawings. The second or inner piece of coated foam 61 may made of the same foam as the coated first or outer piece of foam 59 or alternatively made of a different foam.

Figure 10:
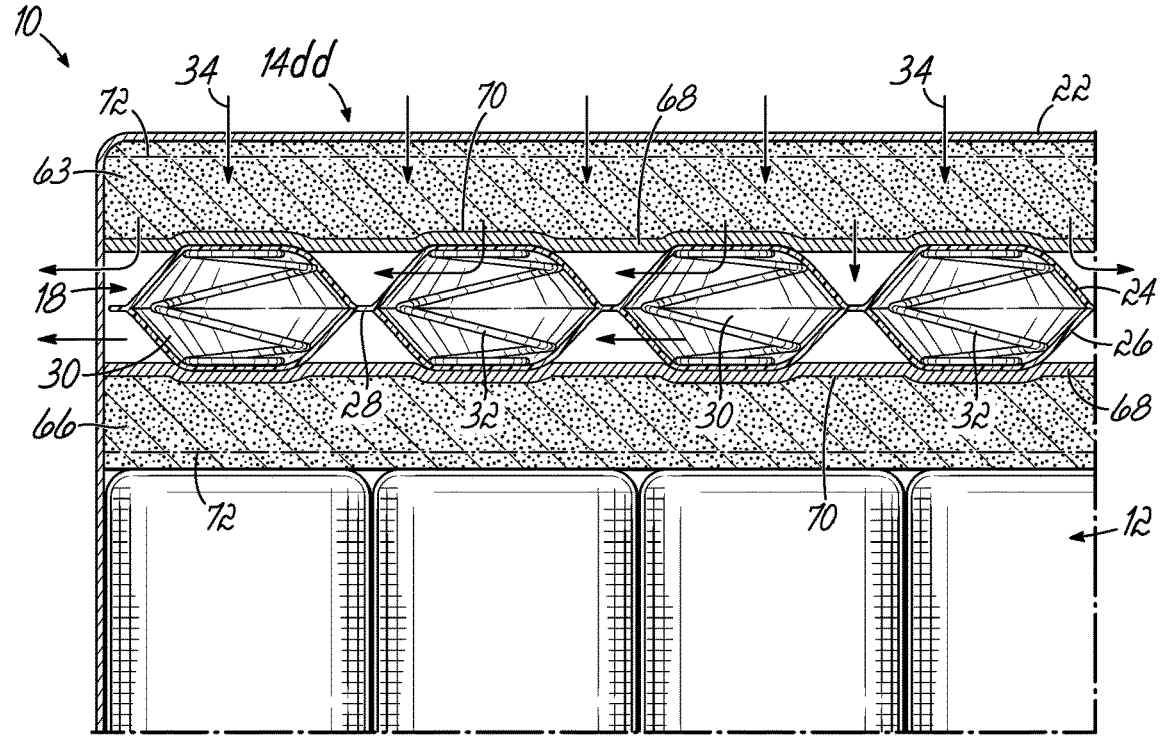
FIG. 10 is a cross-sectional view of a portion of an alternative topper showing inner and outer thermally enhanced foam layers and a pocketed comfort layer therebetween, each of the foam layers being coated with at least one coating.

FIG. 10 illustrates an alternative embodiment of topper 14*dd* which may be incorporated into any bedding or seating product including a single-sided mattress like mattress 10 or a double-sided mattress like mattress 10*a*. Topper 14*dd* comprises a first or outer piece of coated, thermally enhanced foam 63 and pocketed spring comfort layer 18. However, the second or inner piece of foam of topper 14*dd* is a coated, thermally enhanced foam 66. The second or inner piece of coated, thermally enhanced foam 66 of topper 14*dd* has a coating 68 covering at least a portion of an outer surface 70 of the second or inner piece of coated, thermally enhanced foam 66. As shown in FIG. 10, the coating 68 is proximate the pocketed spring comfort layer 18. As shown in FIG. 10, the coating 68 may touch or physically contact the second piece of fabric 26 of the pocketed spring comfort layer 18. The coating 68 may be any desired thickness. Its thickness is not intended to be limited by the drawings. The second or inner piece of coated, thermally enhanced foam 66 may made of the same foam as the coated first or outer piece of coated, thermally enhanced foam 63 or alternatively made of a different foam.

In all the toppers illustrated having at least one piece of foam having a coating, only one coating is shown per piece of foam. A dashed line 72 is shown on each of these pieces of coated foam, showing that a second coating (not shown) could be applied to the piece of foam on another side of the piece of foam. Although the coatings are shown on the inner surfaces of the pieces of foam, they may be additionally or alternatively applied to the outer surfaces of the pieces of foam.

Figure 11:
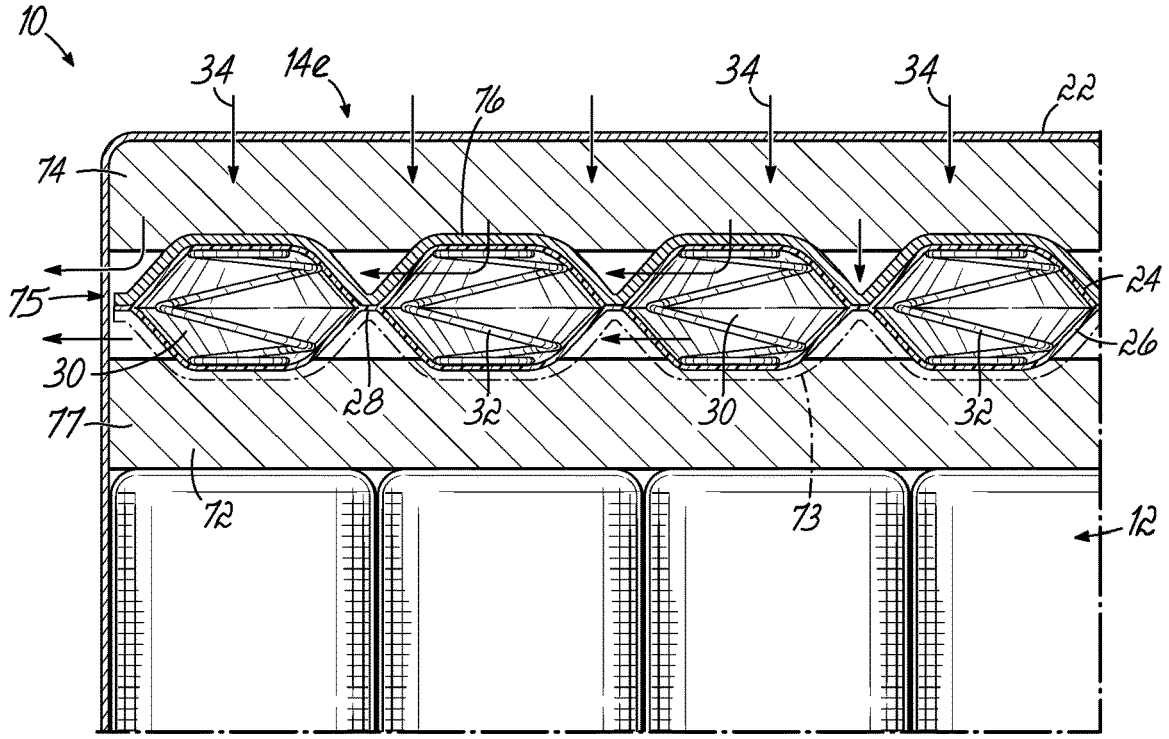
FIG. 11 is a cross-sectional view of a portion of an alternative topper showing inner and outer non thermally enhanced foam layers and a pocketed comfort layer therebetween, at least one of the outer surfaces of the pocketed comfort layer being coated with at least one coating.

FIG. 11 illustrates an alternative embodiment of topper 14*e* which may be incorporated into any bedding or seating product including a single-sided mattress like mattress 10 or a double-sided mattress like mattress 10*a*. Topper 14*e* comprises a first or outer piece of non-thermally enhanced foam 74 and a second or inner piece of non-thermally enhanced foam 77. However, topper 14*e* has a pocketed spring comfort layer 75 different pocketed spring comfort layer 18. Pocketed spring comfort layer 75 comprises the same components as pocketed spring comfort layer 18 including mini coil spring 32 and first and second pieces of fabric 24, 26, respectively. However, pocketed spring comfort layer 75 has a coating 76 covering at least a portion of an outer surface 78 of the first piece of fabric 24 of pocketed spring comfort layer 75. As shown in FIG. 10, the coating 76 is proximate the first or outer piece of non-thermally enhanced foam 74. As shown in FIG. 11, the coating 76 may touch or physically contact the first or outer piece of non-thermally enhanced foam 74. The coating 76 may be any desired thickness. Its thickness is not intended to be limited by the drawings. As shown by dashed line 73, another coating layer may be adhered to the second piece of fabric 26 of the pocketed spring comfort layer 75. The second piece of non-thermally enhanced foam 77 may made of the same foam as the first or outer piece of non-thermally enhanced foam 74 or alternatively made of a different foam.

Figure 12:
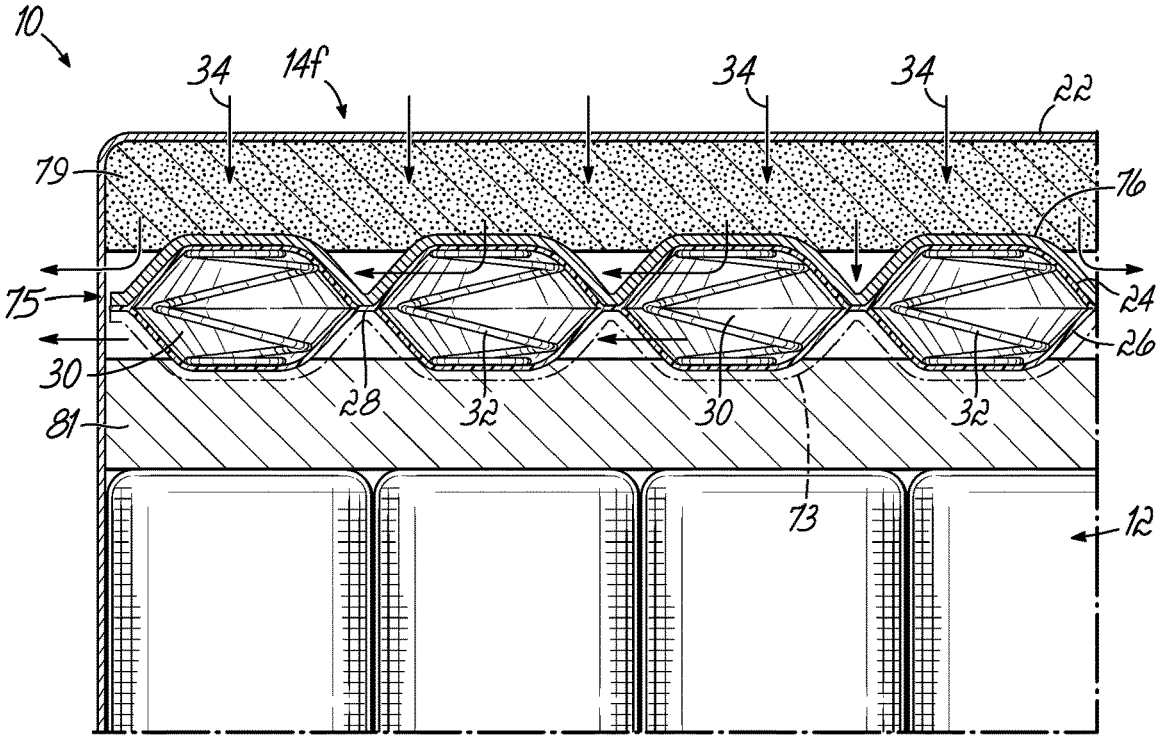
FIG. 12 is a cross-sectional view of a portion of an alternative topper showing an inner non thermally enhanced foam layer, an outer thermally enhanced foam layer and a pocketed comfort layer therebetween, at least one of the outer surfaces of the pocketed comfort layer being coated with at least one coating.

FIG. 12 illustrates an alternative embodiment of topper 14*f* which may be incorporated into any bedding or seating product including a single-sided mattress like mattress 10 or a double-sided mattress like mattress 10*a*. Topper 14*f* comprises a first or outer piece of thermally enhanced foam 79 and a second or inner piece of non-thermally enhanced foam 81. However, topper 14*f* has the same coated, pocketed spring comfort layer 75 as topper 14*e* shown in FIG. 11. As shown by dashed line 73, another coating layer may be adhered to the second piece of fabric 26 of the pocketed spring comfort layer 75. The second piece of non-thermally enhanced foam 81 may made of the same foam as the first or outer piece of thermally enhanced foam 79 or alternatively made of a different foam.

Figure 13:
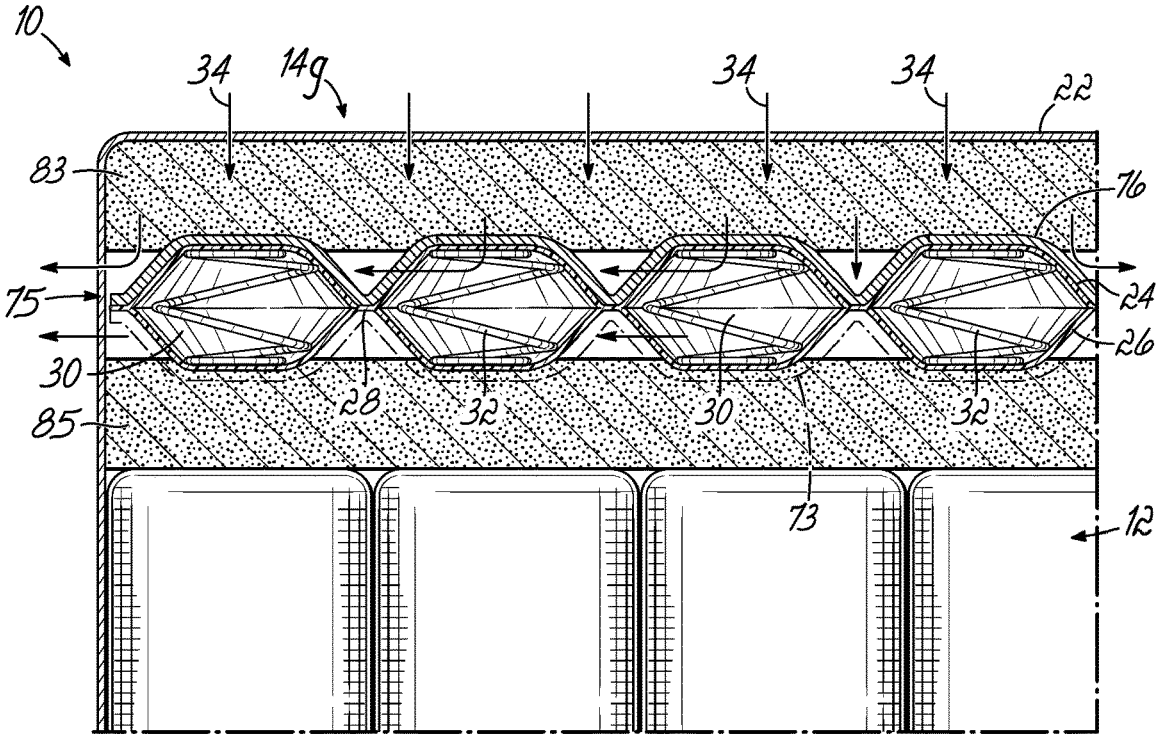
FIG. 13 is a cross-sectional view of a portion of an alternative topper showing inner and outer thermally enhanced foam layers and a pocketed comfort layer therebetween, at least one of the outer surfaces of the pocketed comfort layer being coated with at least one coating.

FIG. 13 illustrates an alternative embodiment of topper 14*g* which may be incorporated into any bedding or seating product including a single-sided mattress like mattress 10 or a double-sided mattress like mattress 10*a*. Topper 14*g* comprises a first or outer piece of thermally enhanced foam 83 and a second or inner piece of thermally enhanced foam 85. However, topper 14*g* has the same coated, pocketed spring comfort layer 75 as topper 14*e* shown in FIG. 11. As shown by dashed line 73, another coating layer may be adhered to the second piece of fabric 26 of the pocketed spring comfort layer 75. The second piece of thermally enhanced foam 85 may made of the same foam as the first or outer piece of thermally enhanced foam 83 or alternatively made of a different foam.

Figure 14:
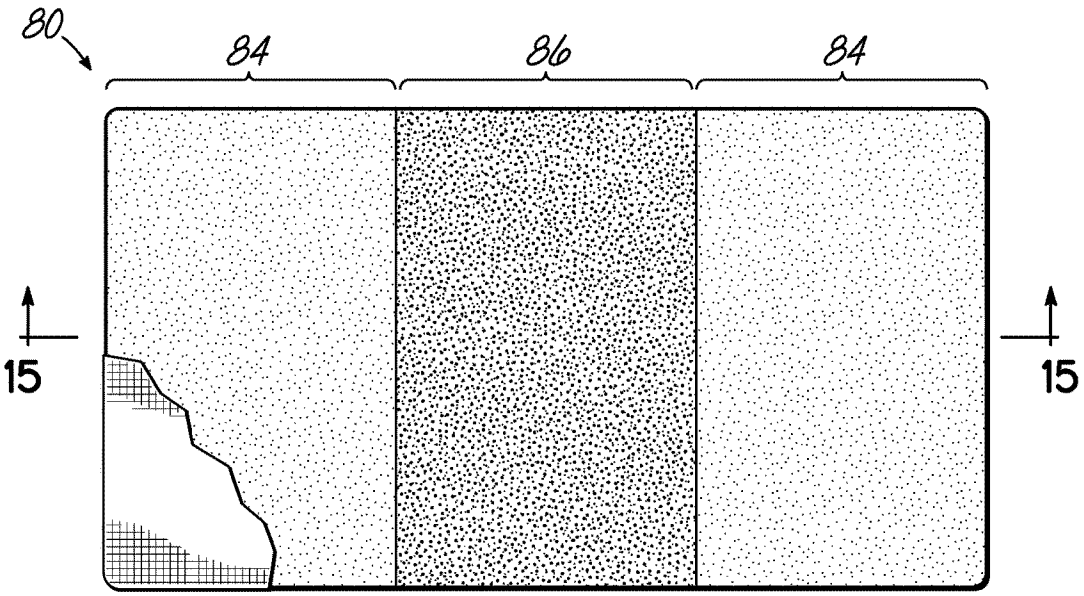
FIG. 14 is a top view of a posturized product in accordance with the present invention.

FIG. 14 illustrates a double-sided mattress 80 having two end sections 84 and a lumbar or middle section 86 therebetween. The double-sided mattress 80 has a posturized topper 82 above a pocketed spring core 12. The same posturized topper 82 is flipped and located below the pocketed spring core 12. Posturized topper 82 has three different areas or regions of firmness or heat management/movement depending upon the composition of the topper within each of the areas or regions. Posturized topper 82 comprises two end sections 91 on opposite sides of a middle section 93. The middle section 93 is designed to transfer heat away from a person sleeping on the double-sided mattress 80 more efficiently than the end sections 84, because the part of a person's body resting upon the middle section is typically hotter than the parts of a person's body resting on the end sections of the mattress.

Although three sections are illustrated in the drawings, any number of sections may be incorporated into a posturized topper. Although each of the sections is illustrated being a certain size, they may be other sizes. The drawings are not intended to be limiting. One or more of the areas/sections may feel cooler or dissipate heat more quickly due to the topper in one area/section having more thermally enhanced pieces of foam than the other areas/sections. The areas/sections may be any desired orientation or size; the drawings are not intended to be limiting.

Figure 15:
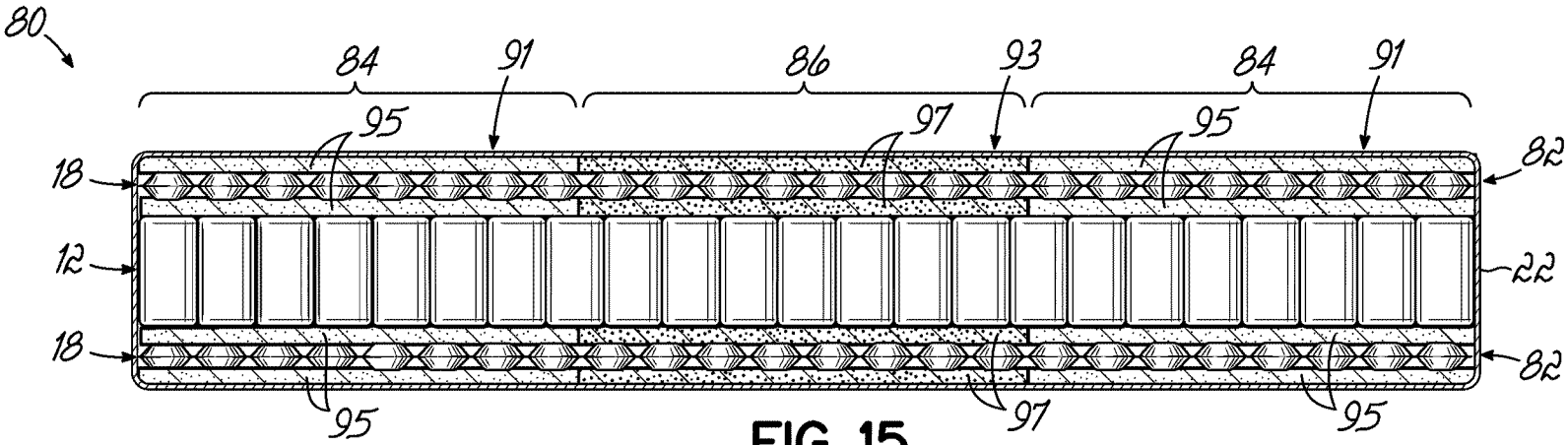
FIG. 15 is a cross-sectional view taken along the line 15-15 of FIG. 14.

As shown in FIG. 15, each of the end sections 91 of posturized topper 82 has upper and lower pieces of non-thermally enhanced foam 95 with a pocketed spring comfort layer 18 therebetween. The middle section 93 of posturized topper 82 has upper and lower pieces of thermally enhanced foam 97 with a pocketed spring comfort layer 18 therebetween. Thus, the middle section 93 of posturized topper 82 is more efficient at moving heat away from the double-sided mattress 80 than the end sections 91 of posturized topper 82. It is within the scope of the present invention that any of the toppers described herein may be used in any sections of a posturized bedding or seating product.

Figure 16:
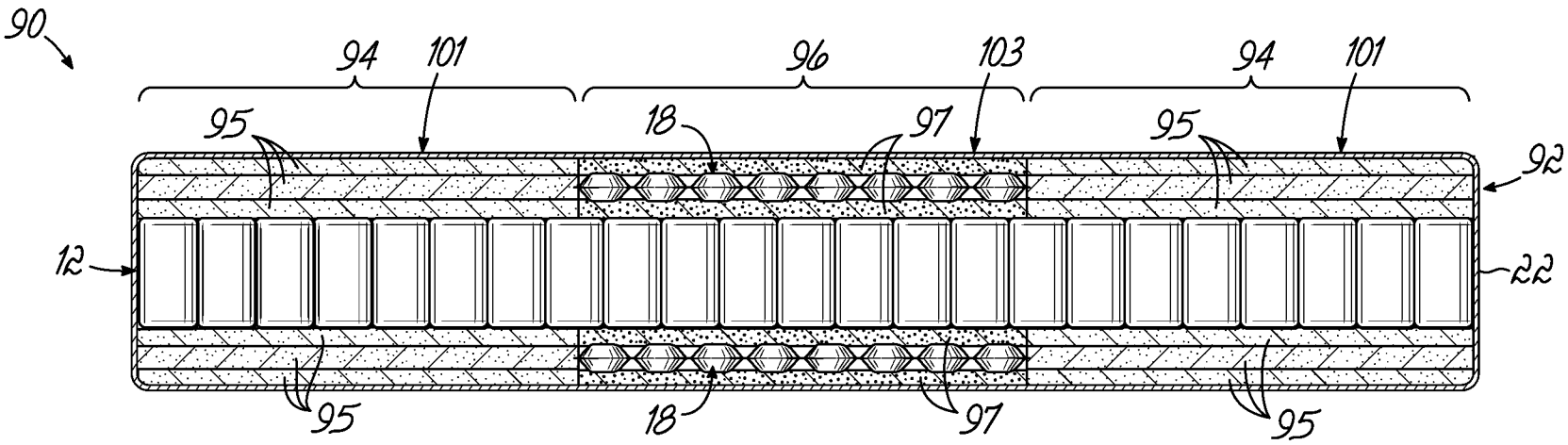
FIG. 16 is a cross-sectional view like FIG. 15 showing a different embodiment.

FIG. 16 illustrates a different posturized double-sided mattress 90 having two end sections 94 and a lumbar or middle section 96 therebetween. The double-sided mattress 90 has a posturized topper 92 above a pocketed spring core 12. The same posturized topper 92 is flipped and located below the pocketed spring core 12. Posturized topper 92 has three different areas or regions of firmness depending upon the composition of the topper within each of the areas or regions. Posturized topper 92 comprises two end sections 101 on opposite sides of a middle section 103. The middle section 103 of posturized topper 92 is designed to transfer heat away from a person sleeping on the double-sided mattress 90 more efficiently than the end sections 101 of posturized topper 92, because the part of a person's body resting upon the middle section is typically hotter than the parts of a person's body resting on the end sections of the mattress.

As shown in FIG. 16, each of the end sections 101 of posturized topper 92 has upper, lower, and middle pieces of non-thermally enhanced foam 95. In place of three pieces of non-thermally enhanced foam 95, a single piece of non-thermally enhanced foam may be used in each of the end sections 101 of posturized topper 92. The middle section 103 of posturized topper 92 has upper and lower pieces of thermally enhanced foam 97 with a pocketed spring comfort layer 18 therebetween. Thus, the middle section 103 of posturized topper 92 is more efficient at moving heat away from the double-sided mattress 90 than the end sections 101 of posturized topper 92. It is within the scope of the present invention that any of the toppers described herein may be used in any sections of a posturized bedding or seating product.

Although FIGS. 14-16 illustrate a double-sided mattress, the same inventive concepts of posturized toppers may be used in a single-sided mattress or any other bedding or seating product.

While we have described several preferred embodiments of this invention, persons skilled in this art will appreciate that other semi-impermeable fabric materials may be utilized in the practice of this invention. Similarly, such persons will appreciate that each pocket may contain any number of coil springs or other type of spring, made of any desired material. Persons skilled in the art may further appreciate that the segments of the weld seams may be stitched, glued or otherwise adhered or bonded. Therefore, we do not intend to be limited except by the scope of the following appended claims.

What is claimed is:

1. A topper configured to overlay a core of a bedding or seating product, the topper comprising:

a first piece of thermally enhanced foam having a uniform thickness;

a second piece of thermally enhanced foam having a uniform thickness; and a pocketed spring comfort layer between the first and second pieces of thermally enhanced foam, wherein the pocketed spring comfort layer comprises mini coil springs, a first piece of fabric on one side of the mini coil springs and a second piece of fabric on another side of the mini coil springs, the first and second pieces of fabric being joined by weld seams at least partially around the mini coil springs thereby creating pockets, at least one of the first and second pieces of fabric having a coating having improved heat absorption characteristics due to microencapsulated phase change materials or gel materials incorporated into the coating, the coating covering at least a portion of an outer surface thereof.

2. The topper of claim 1 wherein at least one of the first and second pieces of fabric is permeable to airflow through the fabric.

3. The topper of claim 1 wherein at least one of the first and second pieces of thermally enhanced foam is flexible polyurethane or latex foam.

4. The topper of claim 1 wherein at least one of the first and second pieces of thermally enhanced foam has a coating thereon.

5. The topper of claim 1 wherein at least one of the first and second pieces of thermally enhanced foam is infused with at least one of the following: carbon fibers, carbon nanotubes, microencapsulated phase change materials, silicon carbide, synthetic diamond, boron nitride.

6. The topper of claim 1 wherein at least one of the first and second pieces of thermally enhanced foam has metal particles infused therein.

7. A topper configured to overlay a core of a bedding or seating product, the topper comprising:

a first piece of thermally enhanced foam having a uniform thickness and metal particles infused therein;

a second piece of foam having a uniform thickness; and a pocketed spring comfort layer between the first piece of thermally enhanced foam and the second piece of foam, wherein the pocketed spring comfort layer comprises a matrix of mini coil springs, a first piece of fabric on one side of the matrix of mini coil springs and a second piece of fabric on another side of the matrix of mini coil springs, the first and second pieces of fabric being joined by weld seams at least partially around the mini coil springs thereby creating pockets, at least one of the first and second pieces of fabric having a coating having improved thermal conductivity due to metallic or non-metallic particles being incorporated or infused into the coating, the coating covering at least a portion of an outer surface thereof.

8. The topper of claim 7 wherein at least one of the first and second pieces of fabric is permeable to airflow through the fabric.

9. The topper of claim 7 wherein at least one of the first and second pieces of foam is flexible polyurethane foam.

10. The topper of claim 9 wherein the first and second pieces of foam are both flexible polyurethane foam.

11. The topper of claim 7 wherein at least one of the first and second pieces of foam is latex foam.

12. The topper of claim 7 wherein at least one of the first and second pieces of foam has a coating covering at least one surface thereof.

13. A topper configured to overlay a core of a bedding or seating product, the topper comprising:

a first layer of thermally enhanced foam infused with at least one of the following:

metallic particles, carbon fibers, carbon nanotubes, microencapsulated phase change materials, silicon carbide, synthetic diamond, boron nitride;

a second layer of foam; and a pocketed spring comfort layer between the first and second layers of foam, the pocketed spring comfort layer comprising mini coil springs, a first piece of fabric on one side of the mini coil springs, a second piece of fabric on another side of the mini coil springs, the first and second pieces of fabric being joined by weld seams at least partially around the mini coil springs thereby creating pockets, a coating having improved thermal conductivity due to metallic or non-metallic particles being incorporated or infused into the coating, the coating covering an outside surface of each of the first and second pieces of fabric.

14. The topper of claim 13 wherein the first and second pieces of fabric of the pocketed spring comfort layer are permeable to airflow through the fabric.

15. The topper of claim 13 wherein at least one of the first and second layers of foam has a coating covering at least one surface thereof.

16. The topper of claim 13 wherein each of the first and second layers of foam has a coating covering at least one surface thereof.

17. The topper of claim 13 wherein the second layer of foam has a coating at least partially covering at least one surface thereof.

18. The topper of claim 17 wherein the second layer of foam is thermally enhanced foam.

19. The topper of claim 18 wherein the second layer of foam is infused with at least one of the following: metallic particles, carbon fibers, carbon nanotubes, microencapsulated phase change materials, silicon carbide, synthetic diamond, boron nitride.

20. The topper of claim 18 wherein the second layer of foam is infused with metal particles.

* * * * *